US007810419B2

(12) United States Patent
Rundell et al.

(10) Patent No.: US 7,810,419 B2
(45) Date of Patent: Oct. 12, 2010

(54) ROTATING LOG CLAMP

(75) Inventors: Wayne G. Rundell, Ashland, WI (US); Eric J. Lumberg, Poplar, WI (US); Mark A. Stackley, St. Croix Falls, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 16 days.

(21) Appl. No.: 10/359,029

(22) Filed: Feb. 5, 2003

(65) Prior Publication Data

US 2004/0149103 A1 Aug. 5, 2004

(51) Int. Cl.
*B26D 7/04* (2006.01)
*B26D 3/16* (2006.01)

(52) U.S. Cl. ..... 83/459; 83/452; 83/466; 269/156; 269/157; 269/216; 269/218; 269/229; 269/237; 269/254 R; 269/287; 279/35; 279/71; 279/106; 279/107

(58) Field of Classification Search ..... 83/282, 83/452, 457, 458, 459, 465, 42, 54, 466; 81/57.15, 57.18, 57.2, 57.33; 269/287, 288, 269/86, 134, 138, 156, 157, 160–162, 216–218, 269/225–227, 229, 233, 234, 237–239, 254 R, 269/254 CS, 254 MW; 279/35, 37, 38, 71, 279/72, 106, 107, 133; 82/165, 167
See application file for complete search history.

(56) References Cited

U.S. PATENT DOCUMENTS 1,939,147 A * 12/1933 Snyder ..... 82/165
2,667,356 A 1/1954 Forward
2,776,566 A 1/1957 Schulman et al.
2,890,888 A * 6/1959 Damijonaitis ..... 279/106
2,985,458 A * 5/1961 Everett ..... 279/106
3,005,638 A * 10/1961 McConnell ..... 279/106
3,218,898 A 11/1965 Briscoe
3,292,470 A 12/1966 Nystrand et al.
3,413,667 A * 12/1968 Behnke ..... 470/66
3,518,903 A * 7/1970 Ham et al. ..... 81/57.16
3,561,304 A * 2/1971 Bachmann ..... 82/165
3,610,640 A * 10/1971 Bollin et al. ..... 279/106
RE30,598 E 5/1981 Spencer
4,512,223 A * 4/1985 Puhringer ..... 82/124
4,811,639 A * 3/1989 Gress et al. ..... 82/110
4,819,527 A * 4/1989 Redman ..... 82/165
5,038,647 A * 8/1991 Biagiotti ..... 83/155.1
5,129,296 A 7/1992 Wayne (Continued)

FOREIGN PATENT DOCUMENTS

CH 514380 12/1971

(Continued)

*Primary Examiner*—Clark F. Dexter
(74) *Attorney, Agent, or Firm*—Reinhart Boerner Van Deuren P.C.

(57) ABSTRACT

A rotating log saw clamp for clamping a product roll to be sawn. The rotating log saw clamp includes a first portion disposed for rotation about an axis and a second portion disposed for rotation with the first portion and movable relative to the first portion between an open position and a clamping position. The second portion is rotatable from the clamping position to the open position by relative rotation of the first and second rotating portions in a common direction.

39 Claims, 9 Drawing Sheets

U.S. PATENT DOCUMENTS

| | | | | | |
|---|---|---|---|---|---|
| 5,137,225 | A | | 8/1992 | Biagiotti | |
| 5,152,203 | A | | 10/1992 | Wierschke | |
| 5,172,613 | A | * | 12/1992 | Wesch, Jr. | 81/57.33 |
| 5,195,415 | A | | 3/1993 | Buck et al. | |
| 5,201,501 | A | | 4/1993 | Fassler | |
| 5,214,988 | A | | 6/1993 | Quigley | |
| 5,271,137 | A | | 12/1993 | Schutz | |
| 5,275,072 | A | * | 1/1994 | Schmid et al. | 82/164 |
| 5,289,747 | A | | 3/1994 | Wunderlich | |
| 5,315,907 | A | | 5/1994 | Biagiotti | |
| 5,357,833 | A | | 10/1994 | Biagiotti | |
| 5,383,380 | A | | 1/1995 | Sartori | |
| 5,421,385 | A | | 6/1995 | McGee | |
| 5,453,070 | A | | 9/1995 | Moody | |
| 5,458,033 | A | | 10/1995 | Wierschke | |
| 5,474,646 | A | | 12/1995 | Matteucci | |
| 5,475,917 | A | | 12/1995 | Biagiotti | |
| 5,509,336 | A | | 4/1996 | Biagiotti | |
| 5,522,292 | A | | 6/1996 | Biagiotti | |
| 5,544,557 | A | | 8/1996 | Wierschke | |
| 5,555,783 | A | | 9/1996 | Pienta | |
| 5,557,995 | A | | 9/1996 | Robinson | |
| 5,557,997 | A | | 9/1996 | Wunderlich et al. | |
| 5,605,083 | A | | 2/1997 | Lupke et al. | |
| 5,647,259 | A | | 7/1997 | Biagiotti | |
| 5,713,254 | A | | 2/1998 | Pienta | |
| 5,755,146 | A | | 5/1998 | Lumberg | |
| 5,778,742 | A | | 7/1998 | Stuart | |
| 5,799,555 | A | | 9/1998 | Biagiotti | |
| 5,941,144 | A | | 8/1999 | Lumberg | |
| 5,992,275 | A | | 11/1999 | Castricum | |
| 5,992,277 | A | | 11/1999 | Dalseide | |
| 6,065,378 | A | | 5/2000 | Ricci | |
| 6,227,086 | B1 | | 5/2001 | Lumberg | |

FOREIGN PATENT DOCUMENTS

| | | | |
|---|---|---|---|
| DE | 484150 | | 10/1929 |
| DE | 484151 | | 10/1929 |
| DE | 930737 | | 7/1955 |
| DE | 2446125 | | 4/1976 |
| DE | 3225399 | | 2/1983 |
| EP | 0 391 865 | A2 | 10/1990 |
| EP | 0555190 | | 8/1993 |
| GB | 452180 | | 8/1936 |
| GB | 2 003 409 | A | 3/1979 |

* cited by examiner

ROTATING LOG CLAMP

BACKGROUND OF THE INVENTION

The invention generally relates to clamps. More particularly, the invention relates to clamps for securing rolls of paper (commonly referred to in the trade as "logs") during sawing processes.

Many types of paper are produced in logs for ease of manufacture. As used herein and in the appended claims, the term "log" is meant to include rolls of paper products such as napkins, paper towels, facial tissue, toilet tissue, newsprint, and the like. Also, because the present invention is not limited to rolls of paper products, the term "log" is meant to include rolls of products which are made from other materials including without limitation cellophane, plastic sheeting, and other synthetic materials, fabric, woven, and non-woven textiles and cloth, foil, etc., regardless of product porosity, density, and dimensions. These logs must typically be sawn into shorter rolls more readily used by consumers. Automating the sawing process is necessary to achieve satisfactory production rates. Typically, automated sawing processes have utilized a reciprocating or orbital radial or band saw in combination with a stationary log clamp.

Bias cutting and inadequate clamping of the log reduce the yield of prior art sawing processes. Tremendous pressure is placed on the saw blade as it cuts into the log because the saw blade is normally toothless to avoid shredding the log. Thus, this cutting process often requires greater force to shear the log than a process involving a blade with teeth, increasing bias cutting and log core crushing problems.

Prior art clamps often secure a log using elastic straps or grippers during the sawing process, and can often be adjusted for varying diameters. However, these clamps may allow slight movement during the sawing process, especially for logs of large diameter and heavy density. A clamp should hold the log stable when the blade applies large forces while penetrating the log.

Various clamping methods and apparatus have been used in the past. Nevertheless, a new clamping method and apparatus that provides enhanced performance and results in improved product quality would be welcomed by those in the art.

SUMMARY OF THE INVENTION

Some embodiments of the present invention provide for a clamping apparatus that includes a clamp having a first portion rotatable about an axis and a second portion rotatable about the axis and with respect to the first portion between a first position in which the clamp is tightened with respect to the product roll in the clamp and a second position in which the clamp is loosened with respect to the product roll in the clamp.

In some embodiments, the invention provides a rotating log saw clamp for clamping a product roll to be sawn. The rotating log saw clamp in such embodiments includes a first portion disposed for rotation about an axis and a second portion disposed for rotation with the first portion and movable relative to the first portion between an open position and a clamping position. The second portion is rotatable from the clamping position to the open position in rotation of the first and second rotating portions in a common direction.

In other embodiments, the invention provides a method of clamping a product roll to be sawn in a rotating log saw. The method includes rotating first and second portions in a common direction about an axis, and rotating the second portion relative to the first portion to move the second portion from a clamping position to an open position during rotation of the first and second rotating portions in a common direction.

In another aspect of the present invention, some embodiments provide a rotating log saw clamp for clamping a product roll to be sawn in which the rotating log saw clamp includes a first ring adapted to clamp and rotate about an axis a product roll to be sawn and a second ring rotatably coupled to the first ring. The second ring is driven separately from the first ring for rotation relative to the first ring as the first and second rings rotate together in a common direction. The second ring is rotated relative to the first ring to adjust the clamping of the product roll.

In some embodiments, the invention provides a method of clamping a product roll to be sawn in a rotating log saw clamp, wherein the method includes rotating first and second rings in a common direction about an axis, driving the second ring separately from the first ring for rotation relative to the first ring during rotation of the first and second rings together in a common direction, and adjusting the clamping of the product roll.

Also, in some embodiments, the invention provides a rotating log saw clamp for clamping a product roll to be sawn, wherein the rotating log saw clamp includes a frame, a housing rotatably coupled to the frame about an axis, a plurality of clamps positioned about the axis and movable relative to the axis, and a ring rotatably coupled to the housing about the axis. The housing is disposed for rotation with a product roll to be sawn. The ring is rotatable independently of the housing. The ring is rotatable relative to the housing in common rotation of the housing and ring. The ring is movable relative to the housing to move the plurality of clamps relative to the axis.

In still other embodiments, the invention provides a method of clamping a product roll to be sawn in a rotating log saw clamp, wherein the method includes rotating a housing and a ring in a common direction about a common axis, rotating of the ring independently of the rotation of the housing, rotating the ring relative to the housing during common rotation of the housing and ring, and moving a plurality of clamps relative to the axis by rotating the ring relative to the housing.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof, and can also encompass additional items not listed thereafter. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings.

DETAILED DESCRIPTION

Figure 1:
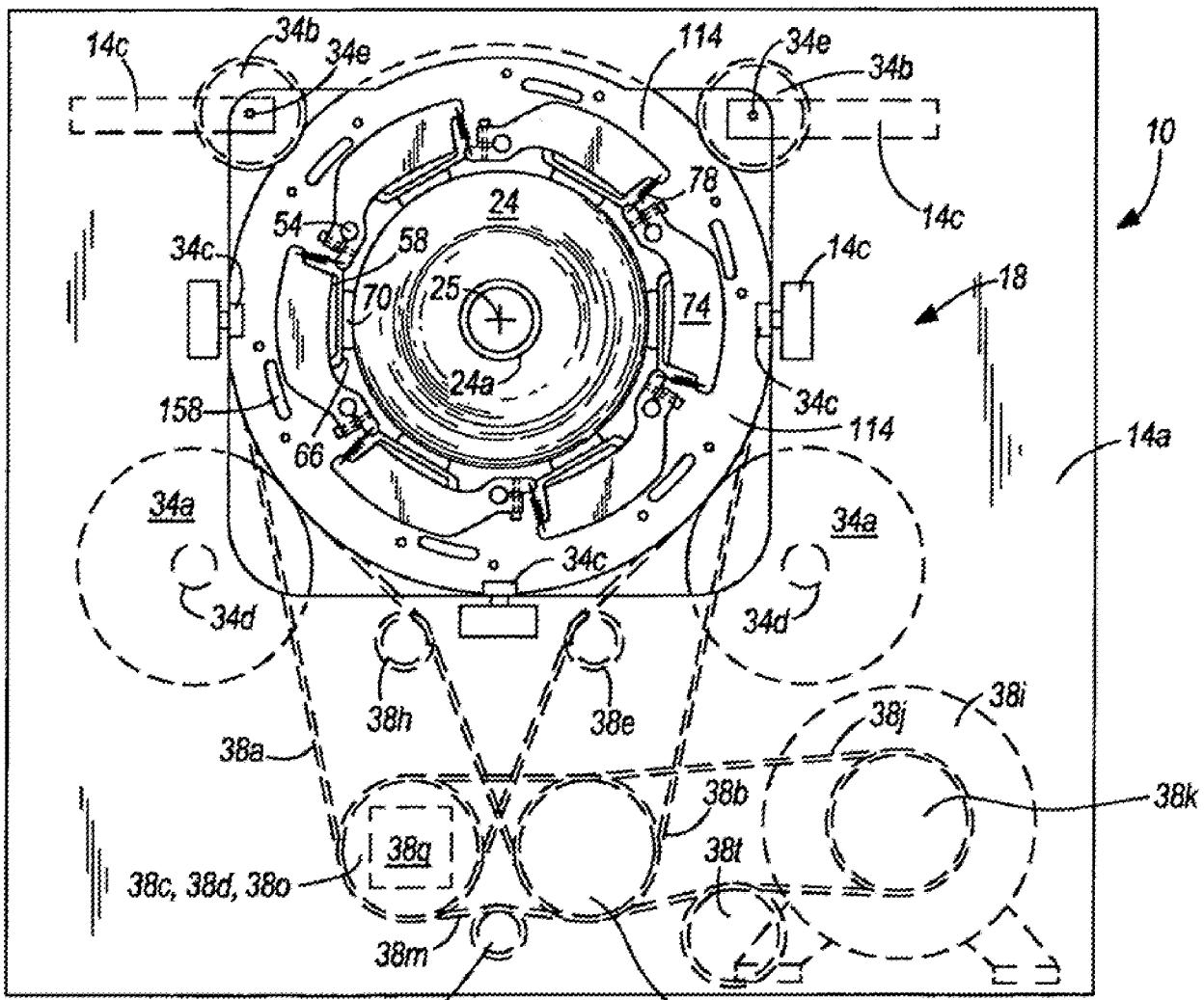
FIG. 1 is a rear elevational view of a log saw assembly constructed in accordance with an exemplary embodiment of the present invention.
Figure 2:
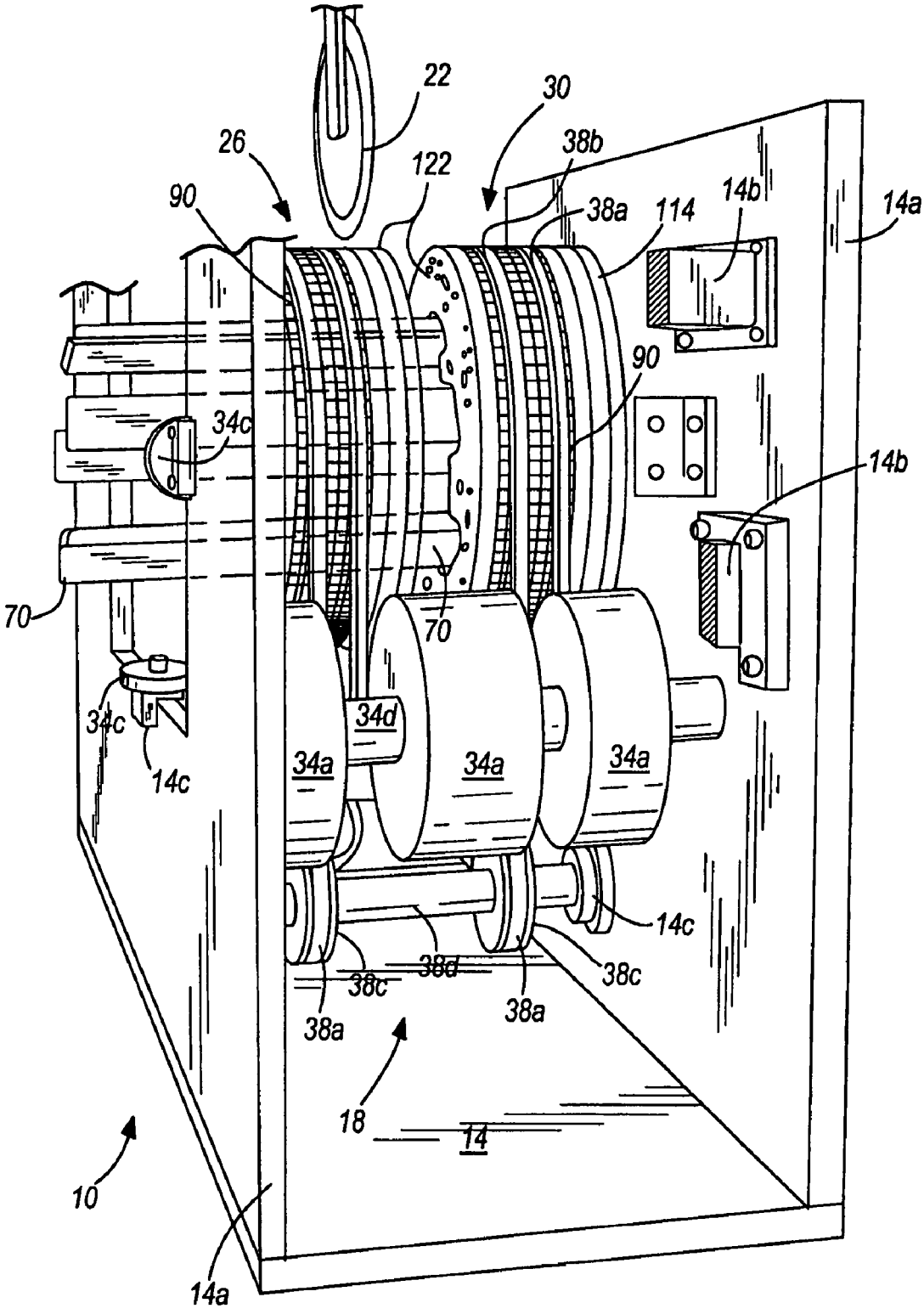
FIG. 2 is a perspective view of the log saw assembly shown in FIG. 1.
Figure 3:
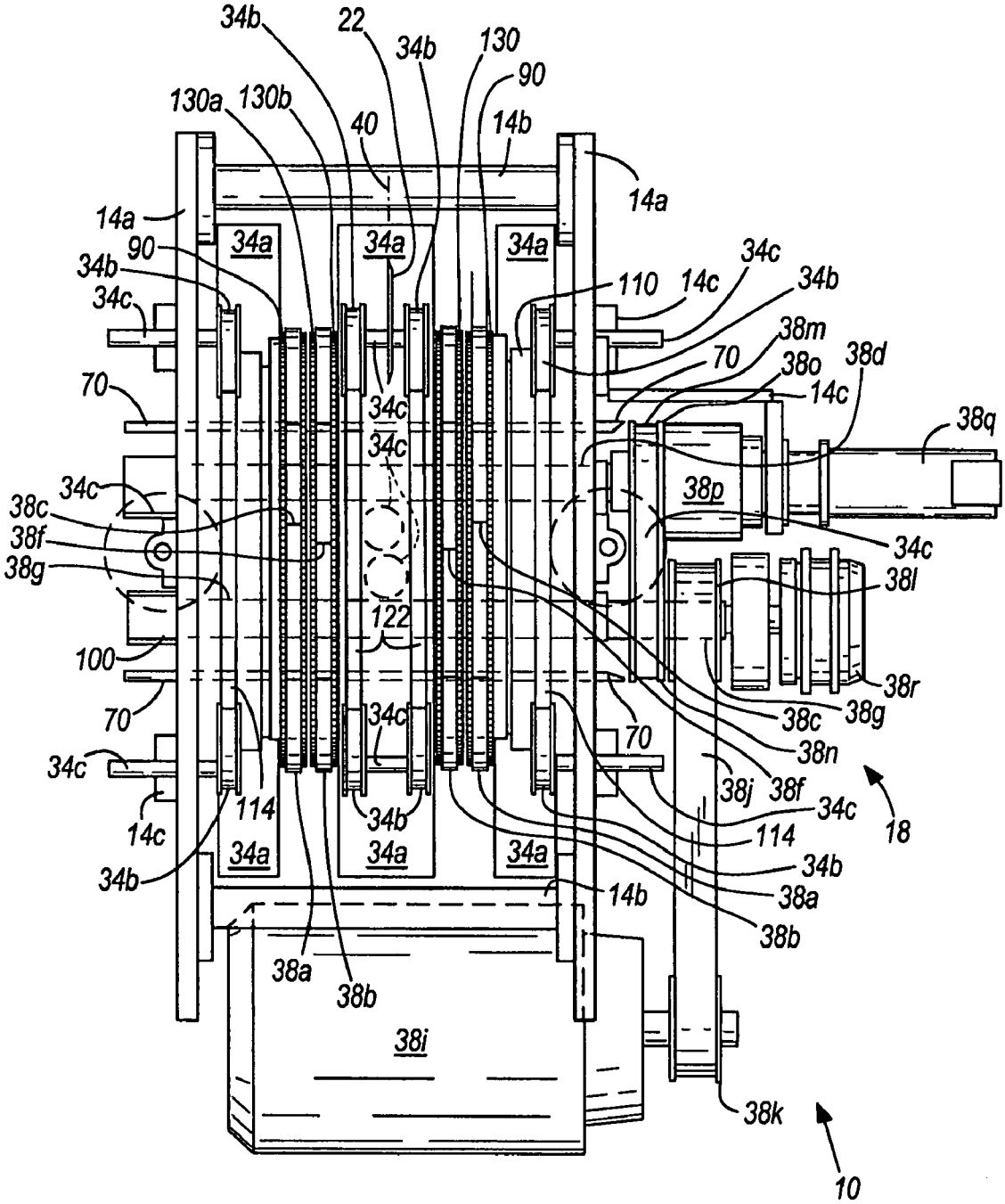
FIG. 3 is a top view of the log saw assembly shown in FIG. 1.

Referring to the figures, and more particularly to FIGS. 1, 2, and 3, a log saw assembly 10 constructed in accordance with an exemplary embodiment of the present invention is illustrated. Although the embodiments of the present invention described below and illustrated in the figures are presented with reference to the log saw assembly 10, it should be noted that the present invention can also be employed in other types of equipment that require clamping operations, whether those operations include sawing or not.

The log saw assembly 10 includes a frame 14, a log saw clamping assembly 18, and a log saw having a log saw blade 22 (schematically illustrated in FIGS. 2 and 3). In some embodiments, as discussed further below, multiple log saw assemblies 10 are utilized in combination. Additionally, other components generally known in the art can be utilized with the log saw assembly 10. In some embodiments, a log pusher is utilized to longitudinally locate a product roll or log 24 along a log axis 25 of the log saw assembly 10.

The log saw clamping assembly 18 includes an infeed clamp 26, an outfeed clamp 30, a support mechanism 34, and a drive mechanism 38. It should be noted that not all components of the log saw clamping assembly 18 are necessary to practice the invention. The invention can include the use of a single clamp. As described further below, the log saw drives the log saw blade 22 along a log saw blade path 40 (FIG. 3). The log saw blade path 40 is a transverse path between the infeed and outfeed clamps 26 and 30.

Figure 5:
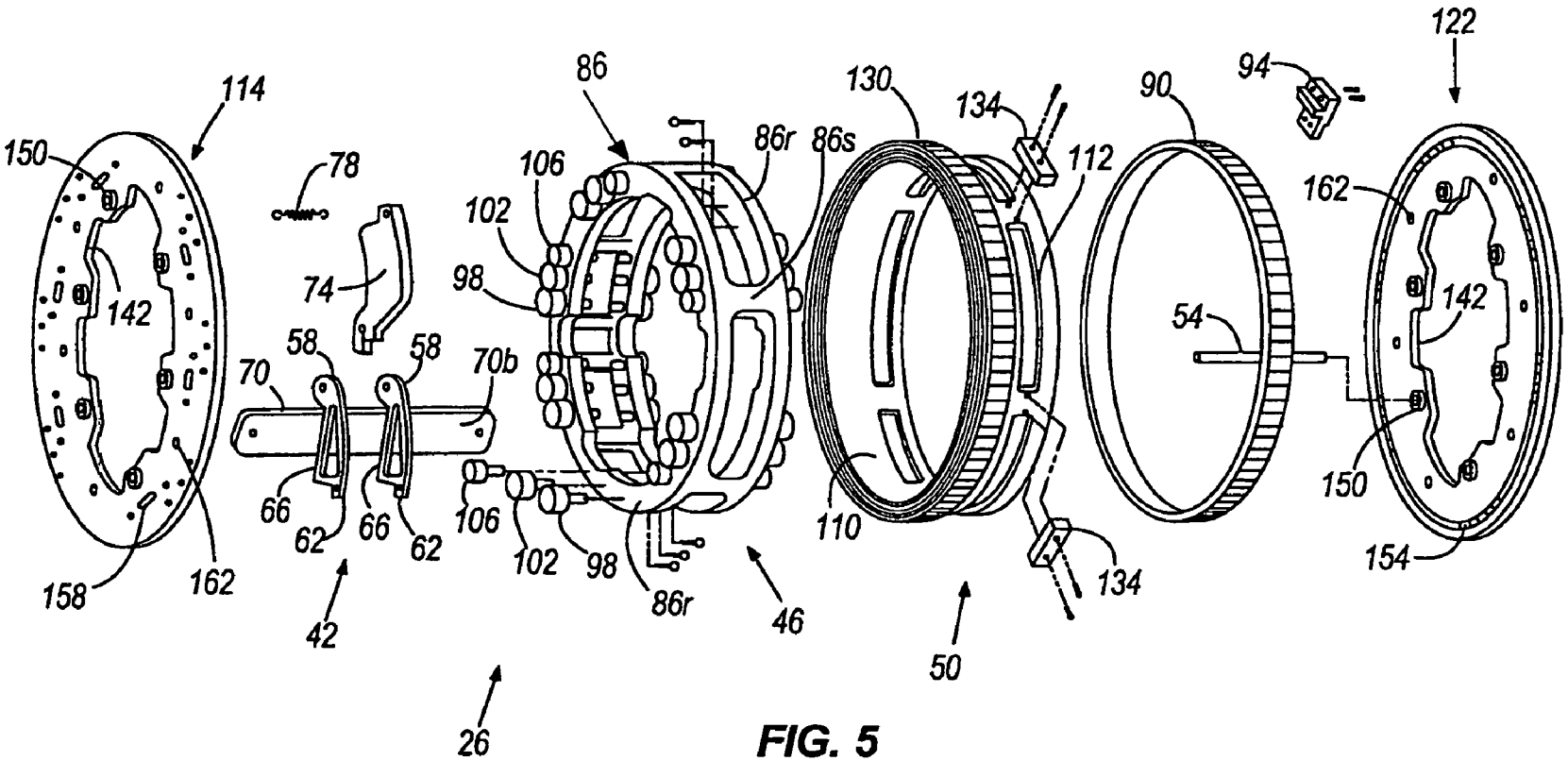
FIG. 5 is an exploded perspective view of the log saw clamp shown in FIG. 4, shown with a pivoting clamp paddle inverted for clarity.

As best shown in FIG. 5, the infeed clamp 26 of the illustrated embodiment includes pivoting clamp paddles 42, a cam follower assembly 46, and a clamp housing assembly 50. FIG. 5 illustrates only a single pivoting clamp paddle 42 which has been inverted for clarity.

Figure 4:
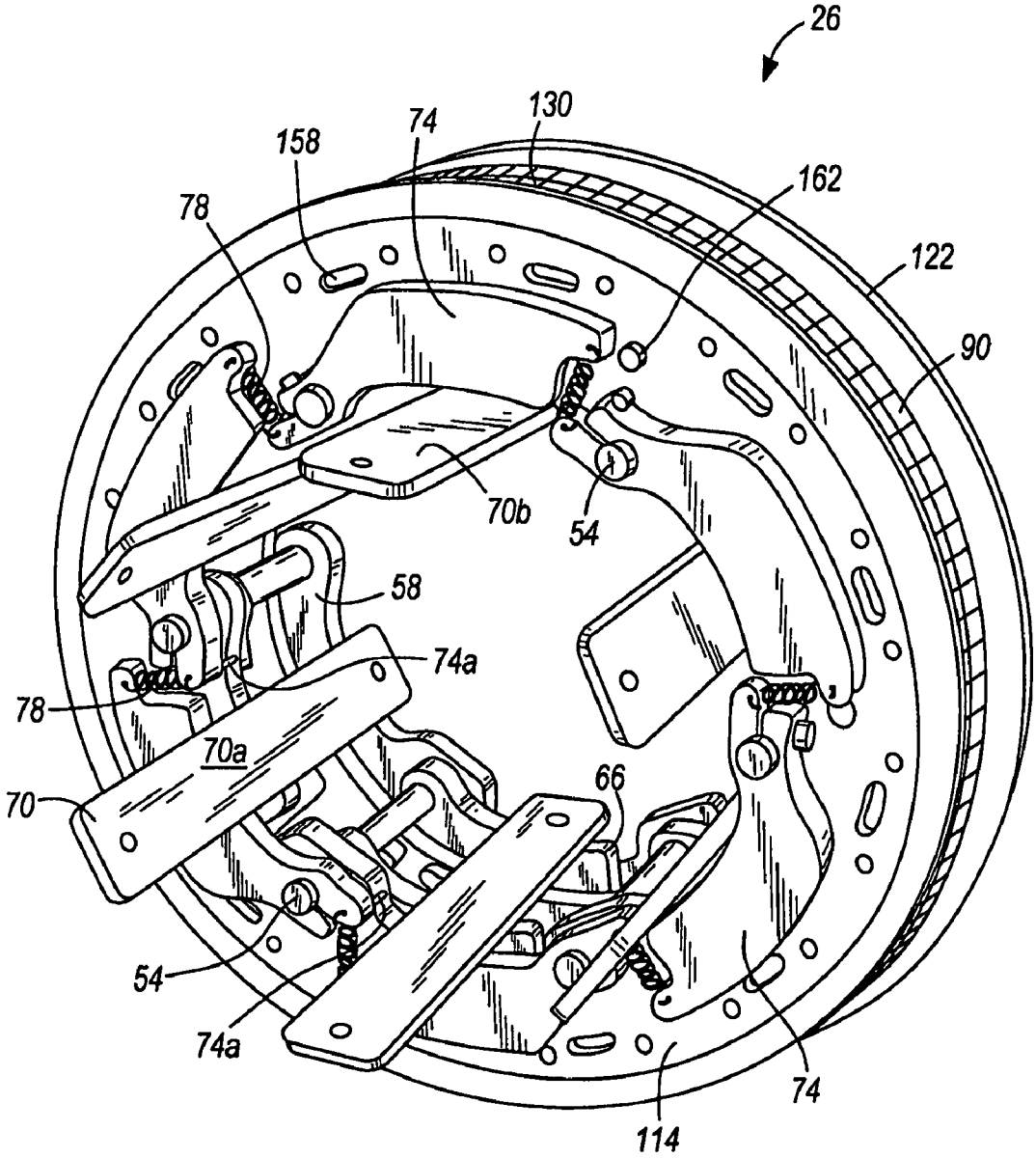
FIG. 4 is a perspective view of a log saw clamp of the log saw assembly shown in FIG. 1.

The pivoting clamp paddles 42 each include a pivot shaft 54 about which the clamp paddles 42 pivot. The pivot shaft 54 is supported by the clamp housing assembly 50 for pivotable rotation of the clamp paddles. Alternatively or in addition, the clamp paddles 42 can be rotatably connected to the pivot shafts 54 for the same motion. First and second pivot arms 58 are connected to the pivot shaft 54 for rotation relative to the cam follower assembly 46. Each pivot arm 58 includes a cam surface 62 and a paddle surface 66. A paddle 70 is utilized to contact the log 24. The paddle 70 may include a variety of shapes (e.g., flat, curved, V-shaped, bar member, pole member, other member, and the like) and sizes. In some embodiments, the leading edge and/or the trailing edge of the paddle 70 is beveled or chamfered to enhance feeding guidance of the log 24 and to prevent gouging of the log 24 upon entrance to or exit from the log saw assembly 10. The illustrated paddle 70 includes a contact surface 70*a* and a connection surface 70*b* (FIG. 4). The connection surface 70*b* is connected to the paddle surfaces 66 of the pivot arms 58 for movement of the paddle 70 therewith. In other embodiments, any number of pivot arms 58 may be utilized to support the paddle (e.g., as few as one, three, or more). In yet other embodiments, the paddle 70 and the pivot arm 58 may be integrally formed.

In some embodiments, a counterweight 74 is connected to the pivot shaft 54 for rotation therewith. As shown in FIGS. 1 and 4, a counterweight spring 78 can be employed to connect the counterweight 74 of one pivoting clamp paddle 42 to the counterweight 74 of an adjacent pivoting clamp paddle 42.

In some embodiments, shoes or extenders (not shown) are connected to the paddles 70 for use in the clamping of product rolls or logs having diameters smaller than the diameter of the log 24. The interstitial space (FIGS. 6-9) between the log 24 and the contact surface 70*a* of the paddle 70 or the extender that is contacting the log 24 can vary. In some embodiments, the interstitial space has a radial thickness of approximately 0.25 inches when the surface contacting the log is in an open position as discussed further below. The thickness of the extenders can vary to accommodate logs of various diameters. In some embodiments, each extender has a length and a width similar to the length and the width of the paddle 70 to which the extender is attached. Also, in some embodiments, the extender can include a body construction similar to the illustrated paddles 70 (in which cases the extenders can define the paddles 70 or can be connected to the paddles in any suitable manner). In other embodiments, the extender includes a frame portion and a paddle portion. Provision of a frame portion can provide the necessary structural integrity of the extender while reducing the overall weight of the extender when compared to a similarly sized extender having a solid body construction. In some embodiments, weight is added to the counterweights 74 to account for the additional weight on the paddles 70.

The cam follower assembly 46 can include a cam follower housing 86 as best shown in FIG. 5. In the illustrated embodiment, the cam follower housing 86 includes first and second cam follower housing rings 86*r* separated by cam follower housing spacers 86*s*. In some embodiments, the cam follower housing 86 is machined from a single piece of material, thereby enhancing the structural integrity of the cam follower housing 86 and helping to provide proper balance of the cam follower housing 86. In other embodiments, components of the cam follower housing 86 are separately manufactured and connected together in any suitable manner (e.g., welding, bolts, screws, pins, rivets, and other conventional permanent and releasable fasteners, inter-engaging components, and the like). In other embodiments, a simple ring or tubular element of any length can be employed.

A cam follower ring gear 90 is connected to the cam follower housing 86 with cam follower ring gear connectors 94. In other embodiments, the cam follower ring gear 90 and the cam follower housing 86 may be integrally formed. In the illustrated embodiment, six circumferentially spaced cam follower ring gear connectors 94 are utilized. In other embodiments, the number of connectors 94 can vary.

In the illustrated embodiment, inner cam followers 98 and outer cam followers 102 are rotatably coupled to the cam follower housing 86. In some embodiments, the inner cam followers 98 are a stud type cam follower and the outer cam followers 102 are an eccentric stud type cam follower, each provided by McGill Manufacturing Company of Valparaiso, Ind. The eccentric stud type cam followers allow for adjustment of the radial position of the outer cam follower 102 relative to the outer cylindrical surface of cam follower housing ring 86*r* to which the outer cam follower 102 is attached. This adjustment is useful in equalizing the load shared by each of the outer cam followers 102. Adjustment may also be necessary to compensate for wear of the cam follower 102 or a cam surface on which the cam follower 102 travels. In other embodiments, other types of inner and/or outer cam followers 98 and 102 are utilized.

In some embodiments, axial alignment mounts 106 are connected to the cam follower housing 86 to help retain the cam follower housing 86 in proper axial position with respect to the clamp housing assembly 50. The axial alignment mounts 106 can be located adjacent the inner and outer cam followers 98 and 102 as shown in FIG. 5. The axial alignment mounts 106 extend axially past the inner and outer cam followers 98 and 102. In some embodiments, the axial alignment mounts 106 are constructed of an ultra high molecular weight polyethylene material, but can be constructed of other material as desired.

With reference to FIG. 5 of the illustrated exemplary embodiment, the inner cam followers 98 and the axial alignment mounts 106 are coupled to the cam follower housing 86 radially inward of the outer cam followers 102. The outer cam followers 102 are mounted such that a portion of each outer cam follower 102 extends radially past the cam follower housing 86. In some embodiments, the number of each of the inner and outer cam followers 98 and 102 and the axial alignment supports 106 is equal to the number of pivoting clamp paddles 42. In other embodiments, the number of each can vary.

The clamp housing assembly 50 includes a barrel housing 110 having elongated apertures 112. In some embodiments, the barrel housing 110 includes six elongated apertures 112 circumferentially spaced about the barrel housing 110. The number of elongated apertures 112 can be equal to the number of cam follower ring gear connectors 94. In other embodiments, the number of each can vary. In some embodiments, one or more cam follower assembly limit stops 134 are connected to the barrel housing 110. The limit stops 134 can be connected between adjacent elongated apertures 112 on the outer cylindrical surface of the barrel housing 110. In the illustrated embodiment, a single cam follower assembly limit stop 134 extends to cover a portion of each of two adjacent elongated apertures 112. In other embodiments, the shape and configuration of the cam follower assembly limit stops 134 can vary. The cam follower assembly limit stops 134 can be constructed of an ultra high molecular weight polyethylene material, although other limit stop materials can be employed as desired.

In some embodiments of the present invention, a first side plate 114 is connected to a first surface of the barrel housing 110 and/or a second side plate 122 is connected to a second surface of the barrel housing 110. In such embodiments, a circular recess or groove 154 (FIG. 5) can be machined in the inner planar surface of each side plate 114 and 122. Where employed, each recess 154 can be sized substantially similar to the corresponding surfaces of the barrel housing 110. The barrel housing 110 can therefore extend into the circular recess(es) 154 when the first and/or second side plates 114 and 122 are connected to the barrel housing 110. In other embodiments, the barrel housing 110 can be integrally formed or otherwise connected with the side plates 114 and 122.

The first and second side plates 114 and 122 can be circular and define an opening 142 through which the log 24 passes. In the illustrated embodiment, the perimeter of the opening 142 is defined by recess portions and flange portions in which are located apertures 150. The first and second side plates 114 and 122 can also include slot apertures 158 and access apertures 162 as desired.

In the illustrated exemplary embodiment, a barrel housing ring gear 130 is connected to the first side plate 114 radially outward of the connection between the barrel housing 110 and the first side plate 114. The inner diameter of the barrel housing ring gear 130 can be substantially equal to the outer diameter of the barrel housing 110. The barrel housing ring gear 130 includes a geared portion 130*a* (FIG. 3) that can be substantially similar to the geared portion of the cam follower ring gear 90. Utilization of similar geared portions allows for synchronization of the drive speeds of the cam follower assembly 46 and the barrel housing assembly 50 about the log axis 25 as discussed further below. The barrel housing ring gear 130 can also include a non-geared portion 130*b* (FIG. 3) that acts to space the barrel housing ring gear 130 from the first side plate 114.

The pivoting clamp paddles 42, the cam follower assembly 46, and the clamp housing assembly 50 of the illustrated embodiment are assembled to form a clamp 26, 30 (e.g., the outfeed clamp 30). The cam follower assembly 46 is supported by the clamp housing assembly 50 for rotation with respect to the clamp housing assembly 50. When the cam follower assembly 46 rotates with respect to the clamp housing 50, the pivoting clamp paddles 42 pivotably rotate to circumferentially engage and disengage the log 24. In some embodiments, the pivoting clamp paddles 42 are spaced circumferentially about the axis 25 to engage the log 24. The operation of the clamp 26, 30 is discussed in greater detail below.

When the clamp 26, 30 is assembled, the pivot shaft 54 of each pivoting clamp paddle 42 is captured in a corresponding set of apertures 150 in the first and second side plates 114 and 122. The apertures 150 can include bearings that enhance rotation of the pivot shafts 54. In some embodiments, the outer surfaces of the pivot arms 58 are axially spaced by a distance substantially equal to the distance between the inner surfaces of the first and second side plates 114 and 122. Such spacing reduces axial movement of the pivoting clamp paddles 42 with respect to the clamp housing assembly 50. Although the counterweights 74 can be located on either side of the first and second side plates 114, 122, the counterweight 74 of each pivoting clamp paddle 42 can be connected to the pivot shaft 54 outboard of side plate 114 (FIGS. 1 and 4) or of both side plates 114, 122. Such placement also reduces the axial movement of the pivoting clamp paddles 42. In those embodiments of the present invention employing side plates 114, 122 having recess portions as described above, the recess portions of the first and second side plates 114 and 122 can be sized to receive a sectional portion of the paddles 70. As illustrated in FIG. 3, the distance by which the paddles 70 extend axially past the first and/or second side plates 114 and 122 can vary.

With continued reference to the illustrated exemplary embodiment of the present invention, the cam follower housing 86 is received radially inboard of the inner cylindrical surface of the barrel housing 110. The cam follower ring gear 90 can be connected to the cam follower housing 86 in any suitable manner, and in the illustrated embodiment is connected to the cam follower housing 86 by the cam follower ring gear connectors 94. For such connection, the cam follower connectors 94 extend radially through the elongated apertures 112. In the illustrated embodiment, the inner diameter of the cam follower ring gear 90 is substantially equal to the outer diameter of the barrel housing 110. The cam follower ring gear 90 in this embodiment is disposed axially adjacent the geared portion 130*a* of the barrel housing ring gear 130 on a first side and the cam follower assembly limit stops 134 on a second side.

In some embodiments, the inner cylindrical surface of the barrel housing 110 defines first and second cam surfaces or tracks on which the sets of outer cam followers 102 are adapted to ride. The outer cam followers 102 can be adjusted as discussed above so the cam follower assembly 46 is concentrically spaced with respect to the inner cylindrical surface of the barrel housing 110.

The illustrated cam followers 98 and 102 rotate about their axes. In other embodiments, the cam followers 98 and 102 can be replaced by wear pins, plates, pads, or other moving and non-moving elements. In other embodiments, the cam follower housing 86 can rotate relative to the barrel housing 110 by employing a set of bearings or wear pads between the cam follower housing 86 and barrel housing 110. In other embodiments, a single structure may perform the function of each cam follower 98 and 102.

The inner surfaces of the first and second side plates 114 and 122 in the illustrated exemplary embodiment prevent axial movement of the cam follower assembly 46 by limiting axial movement of the axial alignment supports 106. If the cam follower assembly 46 begins to move in an axial direction, the axial alignment supports 106 contact the respective inner planar surface of an adjacent side plate 114, 122, which thereby prevents further axial movement in the same direction. To this end, the axial alignment supports 106 can extend axially beyond the inner and outer cam followers 98 and 102 to prevent the cam followers 98 and 102 from contacting the respective inner surfaces of the first and second side plates 114 and 122. Such contact could affect the cam action of the cam followers 98 and 102 in some embodiments.

In some embodiments, the side plates 114 and 122 extend radially past the barrel housing 110, the cam follower ring gear 90, and the barrel housing ring gear 130. Such side plates 114 and 122 therefore have a diameter that is larger than the diameter of the barrel housing 110, the diameter of the cam follower ring gear 90, and the diameter of the barrel housing ring gear 130.

Where employed, the slot apertures 158 are adapted to vent debris to the outside of the clamp 26, 30. The slot apertures 158 can be disposed adjacent and radially inward of the connection between the barrel housing 110 and the side plates 114 and 122. Also where employed, the access apertures 162 allow an operator to access the components (e.g., the outer cam followers 102) of the cam follower assembly 46 if adjustments are necessary.

As illustrated in FIGS. 2 and 3, the infeed clamp 26 can be substantially identical to the outfeed clamp 30 (i.e., the infeed clamp 26 in the illustrated embodiment is a mirror image of the outfeed clamp 30 about the log saw path 40). Accordingly, like parts of the infeed and outfeed clamps 26 and 30 in the illustrated embodiment are indicated with like reference numerals. The only structural difference between the outfeed clamp 30 and the infeed clamp 26 of the illustrated exemplary embodiment is the orientation of the pivoting clamp paddles 42 relative to the clamp housing assembly 50. In particular, the pivoting clamp paddles 42 of the outfeed clamp 30 are orientated in an opposite direction relative to the clamp housing assembly 50 compared to the orientation of the pivoting clamp paddles 42 of the infeed clamp 26 such that the pivoting clamp paddles 42 of the infeed and outfeed clamps 26 and 30 both pivot in the same direction with respect to the axis 25.

Referring to FIGS. 1, 2, and 3, the frame 14 supports the support mechanism 34 and the drive mechanism 38. The frame 14 can have any shape and form suitable for this purpose. By way of example only, the illustrated frame 14 includes vertically extending plate portions 14*a* and horizontally extending support bars 14*b*. A variety of brackets and braces 14*c* can be coupled to the plate portions 14*a* and support bars 14*b* as needed.

In the illustrated embodiment, the support mechanism 34 includes two sets of bottom support rollers 34*a*, two sets of top support rollers 34*b* (not shown in FIG. 2 for clarity), and three sets of thrust support rollers 34*c* (some not shown in FIG. 2 for clarity). The support mechanism 34 is adapted to support the infeed and outfeed clamps 26 and 30 for rotation about the axis 25. Fewer or additional support mechanisms 34 (in the form of rollers, bearings, and the like) can be employed based at least partially upon the type of frame 14 used in various embodiments of the present invention, the anticipated loads exerted by the clamps 26,30 in operation, and other considerations.

With continued reference to the exemplary embodiment of the present invention illustrated in the figures, the bottom support rollers 34*a* are rotatably mounted on a shaft 34*d* for independent rotation. The shaft 34*d* is connected to the frame 14, but can instead be connected to one or more brackets or other structure securing the shaft 34*d* against lateral, axial, and vertical movement. The bottom support rollers 34*a* contact the side plates 114, 122 of the clamps 26, 30, support the clamps 26, 30, and retain the clamps 26, 30 in desired positions with respect to the frame 14. To this end, each top support roller 34*b* can have any shape capable of performing these functions, and in some cases includes a cylindrical support surface (FIG. 1). The cylindrical surfaces of the first and second side plates 114 and 122 of the infeed and outfeed clamps 26 and 30 are supported on the cylindrical support surfaces of the bottom support rollers 34*a*.

Any number of bottom support rollers 34*a* can be employed as desired. In the illustrated embodiment for example, each set of bottom support rollers 34*a* includes a first bottom support roller 34*a* that supports the first side plate 114 of the infeed clamp 26, a second bottom support roller 34*a* that supports the second side plate 122 of the infeed clamp 26 and the second side plate 122 of the outfeed clamp 30, and a third support roller 34*a* that supports the first side plate 114 of the outfeed clamp 30. In other embodiments, the configuration of bottom support rollers 34*a* can vary. The bottom support rollers 34*a* prevent the infeed and outfeed clamps 26 and 30 from moving vertically downward. The bottom support rollers 34*a* can also act in combination with the top support rollers 34*b* to prevent the infeed and outfeed clamps 26 and 30 from moving laterally. In the illustrated embodiment by way of example only, the bottom support rollers 34*a* include a diameter of approximately ten inches. In other embodiments, the diameter of the bottom support rollers 34*a* can vary. Additionally, the axial length of the bottom support rollers 34*a* can vary, although in some embodiments (such as the illustrated embodiment) the bottom support rollers 34*a* are spaced to allow for interaction between the drive system 38 and the infeed and outfeed clamps 26 and 30 as will be described in greater detail below.

Where employed, each top support roller 34*b* is rotatably mounted on a shaft 34*e* for independent rotation. The shaft 34*e* is coupled to a bracket 14*c*, but can instead be connected directly to the frame 14 or to other structure securing the shaft 34*e* against lateral, axial, and vertical movement. The top support rollers 34*b* contact the side plates 114, 122 of the clamps 26, 30 in order to retain the clamps 26, 30 in desired positions with respect to the frame 14. To this end, each top support roller 34*b* can have any shape capable of performing this function, and in some cases includes a grooved support surface (FIG. 3). The grooved support surface of the top support rollers 34*b* are sized to receive surfaces of the first and second side plates 114 and 122 of the infeed and outfeed clamps 26 and 30 for support thereof.

Any number of top support rollers 34*b* can be employed as desired. In the illustrated embodiment for example, each set of top support rollers 34*b* includes a first top support roller 34*b* that supports the first side plate 114 of the infeed clamp 26, a second top support roller 34*b* that supports the second side plate 122 of the infeed clamp 26, a third top support roller 34*b* that supports the second side plate 122 of the outfeed clamp 30, and a fourth support roller 34*b* that supports the first side plate 114 of the outfeed clamp 30. In other embodiments, the configuration of top support rollers 34*b* can vary. The top support rollers 34*a* can prevent the infeed and outfeed clamps 26 and 30 from moving vertically upward. The top support rollers 34*b* can also act in combination with the bottom support rollers 34*a* to prevent the infeed and outfeed clamps 26 and 30 from moving laterally. The top support rollers 34*b* can also act in combination with the thrust support rollers 34*c* to prevent the infeed and outfeed clamps 26 and 30 from moving axially. In the illustrated embodiment by way of example only, the top support rollers 34*b* include a diameter of approximately four inches. In other embodiments, the diameter of the top support rollers 34*b* can vary.

Where employed, each thrust support roller 34*c* is rotatably mounted to the frame 14 for independent rotation, but can instead be connected to one or more brackets or other structure securing the support roller 34*c* against lateral, axial, and vertical movement. To this end, each thrust support roller 34*c* can have any shape capable of providing such support, and in some cases includes a cylindrical support surface. The outer surfaces of the first and second side plates 114 and 122 of the infeed and outfeed clamps 26 and 30 are supported by the cylindrical support surfaces of the thrust support rollers 34*c*.

Any number of thrust support rollers 34*c* can be employed as desired. In the illustrated embodiment for example, each set of thrust support rollers 34*c* includes a first set of thrust support rollers 34*c* that supports the outer surface of the first side plate 114 of the infeed clamp 26, a second set of thrust support rollers 34*c* that supports the outer surface of the second side plate 122 of the infeed clamp 26, a third set of thrust support rollers 34*c* that supports the outer surface of the second side plate 122 of the outfeed clamp 30, and a fourth set of thrust support rollers 34*c* that supports the outer surface of the first side plate 114 of the outfeed clamp 30. The thrust support rollers 34*c* can prevent the infeed and outfeed clamps 26 and 30 from moving axially.

The cam follower ring gear 90 and the barrel housing ring gear 130 can be rotated in a variety of conventional manners (e.g., chains, belts, and the like). The embodiment of the present invention illustrated in the figures provides an example of a drive mechanism 38 that can be employed for this purpose. The cam follower assembly 46 and the clamp housing assembly 50 are each rotatable about the log axis 25. Additionally, the cam follower assembly 46 is rotatable with respect to the clamp housing assembly 50 to cause the pivoting clamp paddles 42 to move circumferentially inward and outward to engage and disengage the log 24 as will be discussed in greater detail below. As also discussed further below, the direction of circumferential movement of the pivoting clamp paddles 42 depends on the direction of rotation of the cam follower assembly 46 with respect to the clamp housing assembly 50. In other embodiments, the clamp housing assembly 50 may be rotatable with respect to the cam follower assembly 46.

In the illustrated embodiment, cam follower drive belts 38*a* are drivingly coupled to the cam follower ring gears 90 of the infeed and outfeed clamps 26 and 30, while barrel housing drive belts 38*b* are drivingly coupled to the barrel housing ring gears 130 of the infeed and outfeed clamps 26 and 30. In some embodiments, each cam follower drive belt 38*a* is driven by a cam follower gear 38*c* mounted on a cam follower shaft 38*d* for rotation therewith. A cam follower drive belt tensioner 38*e* (FIG. 1) can be utilized to appropriately tension the cam follower drive belt 38*a* for operation. In some embodiments, each barrel housing drive belt 38*b* is driven by a barrel housing gear 38*f* mounted on a barrel housing shaft 38*g* for rotation therewith. A barrel housing drive belt tensioner 38*h* (FIG. 1) can be utilized to appropriately tension the barrel housing drive belt 38*b* for operation.

Any driving device can be employed to power the clamps 26, 30. By way of example only, a motor (e.g., a fifteen horsepower electric motor) 38*i* is employed in the illustrated embodiment, and is drivingly connected to the barrel housing shaft 38*g* by a timing belt 38*j* (although other conventional driving elements can be employed in alternative embodiments). The timing belt 38*j* is driven by a motor drive gear 38*k* mounted on an output shaft of the motor 38*i*. The timing belt 38*j* drives the barrel housing shaft 38*g* either directly or indirectly (e.g., via a barrel housing drive gear 381 mounted on the barrel housing shaft 38*g* as shown in the figures). A timing belt 38*m* drivably couples the barrel housing shaft 38*g* to the cam follower shaft 38*d* in any suitable manner. By way of example only, the timing belt 38*m* can be driven by a barrel housing drive gear 38*n* and can drive a gear 38*o* coupled to a differential gear box 38*p*. Tensioners 38*t* and 38*s* can be utilized to appropriately tension the timing belts 38*j* and 38*m* for operation.

The differential gear box 38*p* allows for a differential between the speeds of the cam follower shaft 38*d* and the barrel housing shaft 38*g*. In other embodiments, the differential gear box 38*p* can be coupled to the barrel housing shaft 38*g* and the cam follower shaft 38*d* can be driven by the timing belt 38*j*. In some embodiments, the differential gear box 38*p* includes an 80:1 trim ratio. A servo motor 38*q* can be coupled to the differential gear box 38*p* to control the differential between the speeds of the cam follower shaft 38*d* and the barrel housing shaft 38*g*. In some embodiments, actuation of the servo motor 38*q* results in a speed differential of plus or minus approximately 2-3 revolutions per minute ("RPM") for the cam follower shaft 38*d* when compared to the standard operating speed of the barrel housing shaft 38*g* of approximately 300-400 RPM. As an alternative to a differential gear box 38*p* to provide a speed difference between the shafts 38*d*, 38*g* (controllable or otherwise), any conventional mechanism or assembly for establishing a speed difference between rotating elements can instead be employed. The speed differential of the cam follower shaft 38*d* when compared to the barrel housing shaft 38*g* results in rotation of the cam follower assembly 46 with respect to the barrel housing 50. In some embodiments, a braking mechanism 38*r* (e.g., an air brake) is utilized to slow the rotation of the drive mechanism 38.

Figure 6:
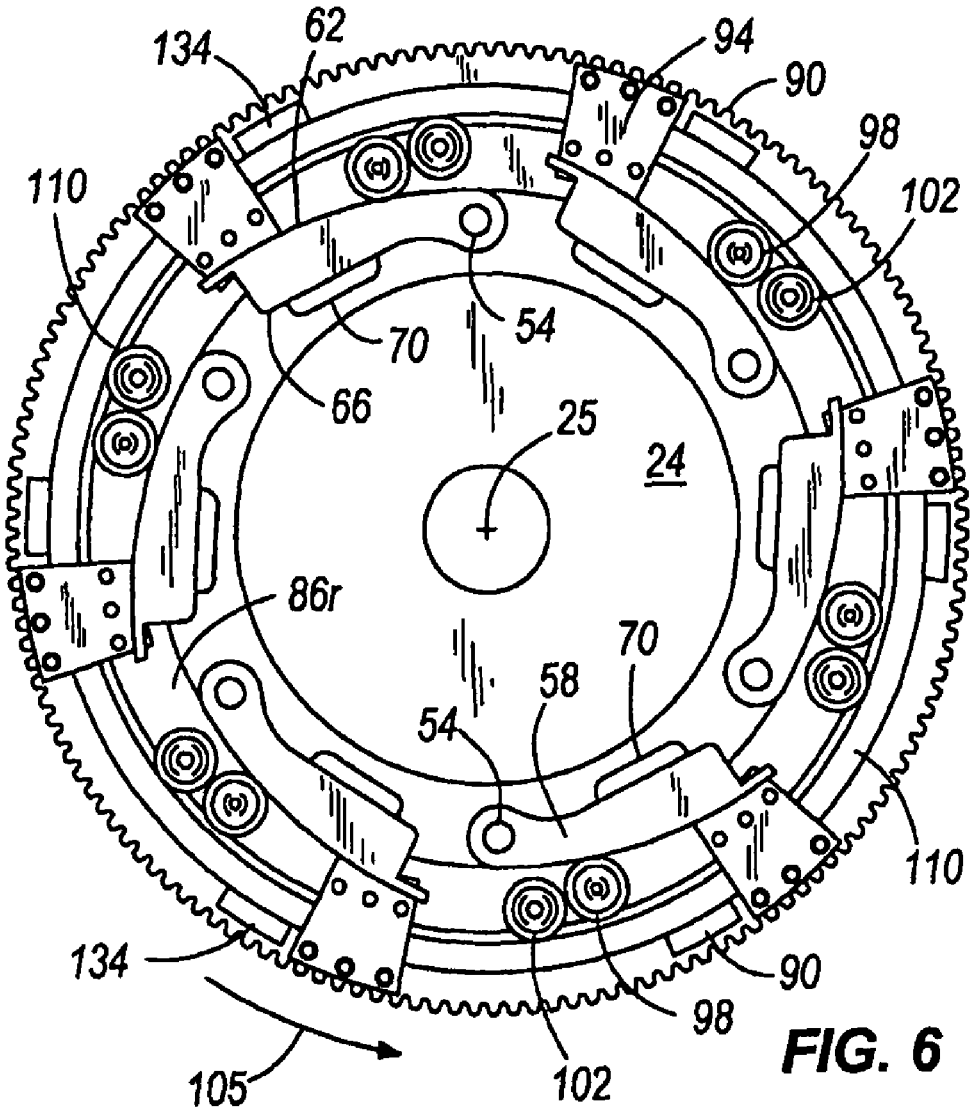
FIG. 6 is a simplified end view of the log saw clamp shown in FIG. 4.
Figure 7:
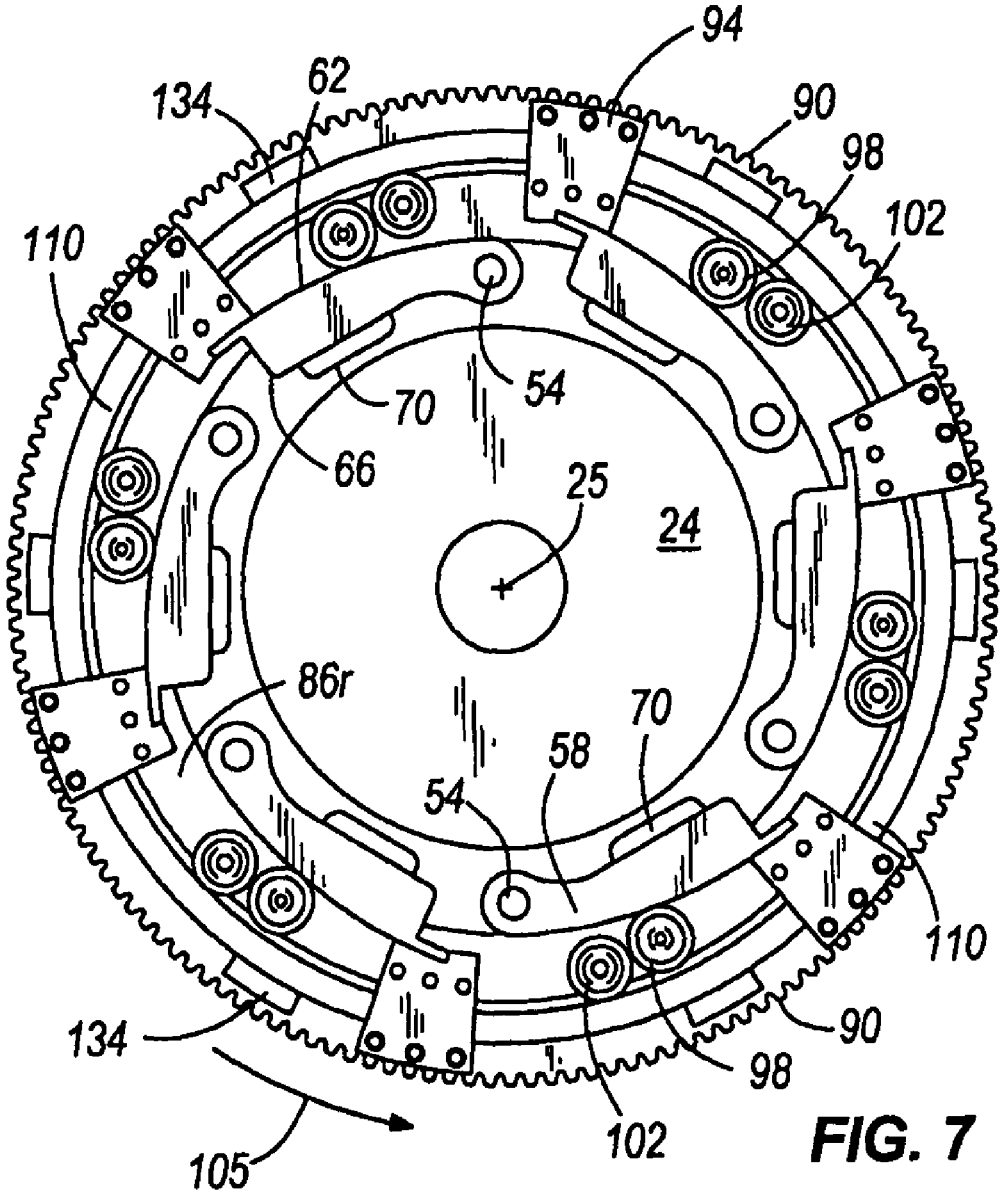
FIG. 7 is a view similar to FIG. 6, with the clamp paddles moved toward a product roll.
Figure 8:
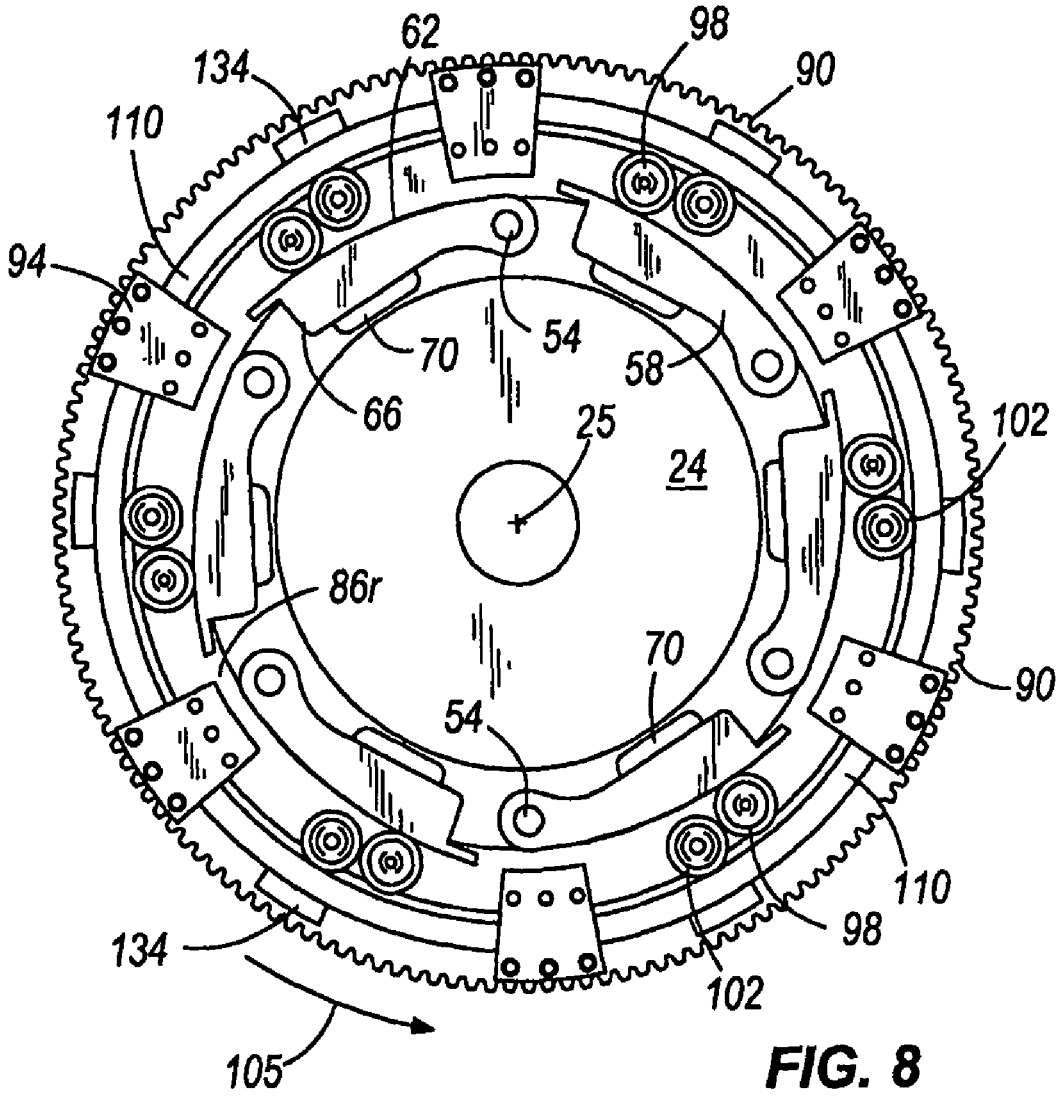
FIG. 8 is a view similar to FIG. 6, with the clamp paddles moved further toward the product roll.
Figure 9:
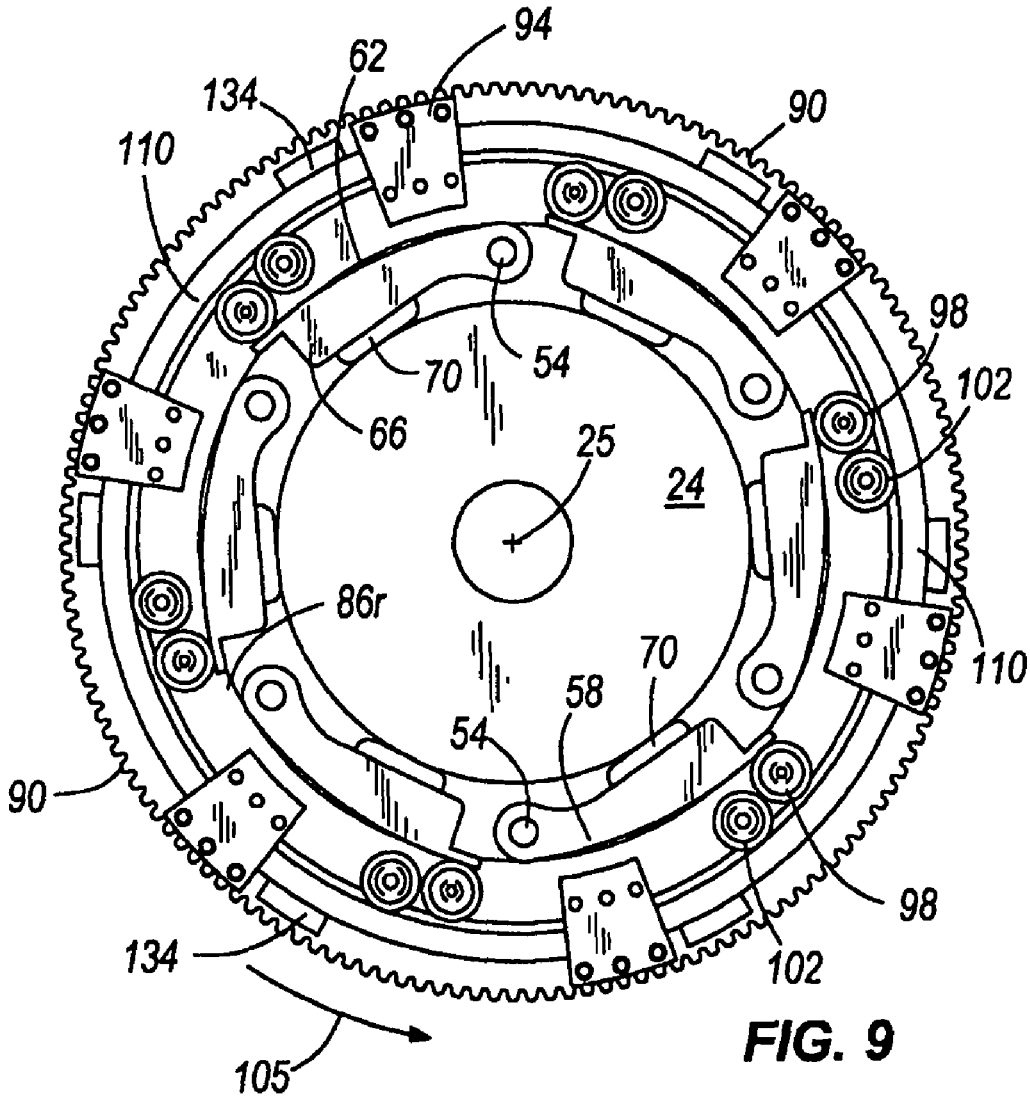
FIG. 9 is a view similar to FIG. 6, with the clamp paddles in a clamped position with respect to the product roll.

For operation, the pivoting clamp paddles 42 include different positions with respect to the log 24. FIG. 6 illustrates the pivoting clamp paddles 42 in an open or indexing position with respect to the log 24. FIGS. 7 and 8 each illustrate the pivoting clamp paddles 42 in a rotating position with respect to the log 24. FIG. 9 illustrates the pivoting clamp paddles 42 in a cutting, sawing, or clamping position with respect to the log 24. The position of the pivoting clamp paddles 42 with respect to the log 24 is defined by the extent of rotation of the cam follower assembly 46 with respect to the clamp housing assembly 50.

In the illustrated embodiment, the cam follower assembly 46 is allowed to rotate approximately thirty degrees with respect to the clamp housing assembly 50. In other embodiments, this amount of rotation can be larger or smaller as desired. As used herein, degrees of rotation are defined with respect to the direction of operational rotation of the infeed and outfeed clamps 26 and 30 illustrated in the figures. The outfeed clamp 30 as illustrated in FIGS. 6-9 includes a counter-clockwise direction of operational rotation as indicated by arrow 105. Therefore, the cam follower assembly 46 and the clamp housing assembly 50 of the outfeed clamp 30 can both rotate in a counter-clockwise direction about the axis 25 during operation of the log saw assembly 10.

The clamping action of the invention is provided when the cam follower assembly 46 rotates with respect to the clamp housing assembly 50. As discussed above, movement of the outer cam followers 102 on the tracks of the barrel housing 110 in the illustrated embodiment allow for such rotation. With reference to FIGS. 6-9, the cam follower assembly 46 rotates in a counter-clockwise direction with respect to the clamp housing assembly 50 when the differential speed between the cam follower assembly 46 and the clamp housing assembly 50 is positive. The cam follower assembly 46 rotates in a clockwise direction with respect to the clamp housing assembly 50 when the differential speed between the cam follower assembly 46 and the clamp housing assembly 50 is negative. The cam follower assembly 46 does not rotate with respect to the clamp housing assembly 50 when there is no differential speed between the cam follower assembly 46 and the clamp housing assembly 50.

In the open position, the cam follower assembly 46 is rotated approximately zero degrees with respect to clamp housing assembly 50. In the sawing position, the cam follower assembly 46 is rotated approximately thirty degrees with respect to the clamp housing assembly 50 in the illustrated embodiment (although other amounts of rotation can instead be employed, depending at least partially upon the size and shape of the pivot arms 58 and the amount of radial movement desired for clamping. In the various rotating positions, the cam follower assembly 46 is rotated with respect to the clamp housing assembly 50 somewhere between the open position and the sawing position. In some embodiments, the pivoting clamp paddles 42 are in a rotating position when the cam follower assembly 46 is rotated between approximately ten and twenty degrees with respect to the clamp housing assembly 50. In other embodiments, the positions of the pivoting clamp paddles 42 can vary.

In the open position, the pivoting clamp paddles 42 are each retracted, and can be in a fully retracted position in which no further radially outward movement of the clamp paddles 42 is possible. When the pivoting clamp paddles 42 are retracted, the connection surfaces 70*b* of the paddles 70 can rest against the recess portions (where employed) of the first and second side plates 114 and 122. Thus, the interstitial space between the contact surfaces 70*a* of the paddles 70 and the log 24 can be the greatest in these positions of the paddles 70. As discussed above, extenders can be utilized to radially extend the contacting surface of the pivoting clamp paddles 42 towards the log 24 if the interstitial space is too large. Additionally, when the pivoting clamp paddles 42 are in an open position, in some embodiments the cam follower ring gear connectors 94 (where employed) are each restricted from movement against the direction of rotation of the infeed and outfeed clamps 26 and 30 by the cam follower assembly limit stops 134. In the illustrated embodiment for example, the cam follower assembly limit stops 134 restrict rotation of the cam follower assembly 46 with respect to the clamp housing assembly 50 to approximately thirty degrees, although other ranges of movement are possible based at least partially upon the positions of the cam follower assembly limit stops 134.

To begin operation of the illustrated log saw assembly 10 (having infeed and outfeed clamps 26, 30), a log pusher advances the log 24 axially into the log saw clamping assembly 18 while the pivoting clamp paddles 42 are in the open position. The log 24 is axially advanced until a portion of the log 24 extends past the log saw blade path 40 into the outfeed clamp 30. Typically, a small length or "cookie" is cut from the leading edge of the log 24 to eliminate the ragged edge produced by many rewinding processes.

Once the log 24 is axially located, the rotation of the infeed and outfeed clamps 26 and 30 can be utilized to accelerate the log 24 from a standstill to the desired rotational speed in a fast and controlled manner. In some cases, the log 24 can be inserted in the log saw assembly 10 while the infeed and outfeed clamps 26, 30 are rotating. The drive mechanism 38 provides rotation to the infeed and outfeed clamps 26 and 30 as discussed above. To accelerate the log 24, the pivoting clamp paddles 42 can be moved concentrically inward from the open position toward the axis 25 and to a rotating position. Concentric movement of the pivoting clamp paddles 42 can be utilized to center the log 24 on the axis 25.

As discussed above, the pivoting clamp paddles 42 move from the open position to a rotating position when the differential speed between the cam follower assembly 46 and the clamp housing assembly 50 is positive. With reference to FIGS. 6-9 for example, counter-clockwise movement of the cam follower assembly 46 with respect to the clamp housing assembly 50 results in movement of the inner cam followers 98 with respect to the cam surfaces 62 of the pivot arms 58 in a direction away from the pivot shaft 54. This cam action moves the contact surfaces 70*a* concentrically inward toward the axis 25. When the pivoting clamp paddles 42 are in a rotating position, the cam follower ring gear connectors 94 are disposed between two adjacent cam follower assembly limit stops 134 (if employed). Therefore, the cam follower assembly limit stops 134 do not restrict the above-described movement of the cam follower assembly 46 with respect to the clamp housing assembly 50 in the counter-clockwise direction or the clockwise directions.

When the log 24 has reached a desired rotational speed, the pivoting clamp paddles 42 can move concentrically inward toward the axis to engage the log 24 for cutting. As discussed above, the pivoting clamp paddles 42 move from a rotating position to the sawing position when the differential speed between the cam follower assembly 46 and the clamp housing assembly 50 is positive. With reference again to FIGS. 6-9 for example, continued counter-clockwise movement of the cam follower assembly 46 with respect to the clamp housing assembly 50 results in continued movement of the inner cam followers 98 with respect to the cam surfaces 62 of the pivot arms 58 in a direction away from the pivot shaft 54. This cam action moves the contact surfaces 70*a* concentrically further inward toward the axis 25. When the pivoting clamp paddles 42 are in the sawing position, the cam follower ring gear connectors 94 are each restricted from movement in the direction of rotation of the infeed and outfeed clamps 26 and 30 by the cam follower assembly limit stops 134 (if employed). Once the sawing position is achieved, the log saw blade 22 is utilized to saw the portion of the log 24 through which the log saw blade path 40 extends.

In some embodiments, the log saw blade 22 is coupled to a pivoting arm for lowering the log saw blade 22 into the log 24. The log saw blade 22 cuts through the exterior of the log 24 first and proceeds radially inward until a portion of the log saw blade 22 extends through the core 24*a* (FIG. 1) of the log 24, or through a center portion of the log in the case of coreless logs. In some embodiments in which logs having cores are cut, the log saw blade 22 extends through the core 24*a* approximately 0.25 inches. The log saw blade 22 can be rotated by a variety of conventional mechanisms or can be rotated by the drive mechanism 38. Alternatively, the log 24 can be "sawn" by a log saw comprising high pressure fluid or solid application, or even by hot wire, torch or laser cutting.

In the illustrated embodiment, the log saw blade 22 rotates at a higher rate of speed than the infeed and outfeed clamps 26 and 30. In some embodiments, rotation of the log 24 through at least 170 degrees prevents the log saw blade 22 from having to travel more than about half the diameter of the log 24. In addition, the rotational speed of the log 24 can define the duration of sawing necessary to saw through the entire section of the log 24. This sawing process can more evenly load the log saw blade 22 and the core of the log 24, thereby substantially reducing bias cutting and core crushing problems and increasing product quality. Further, decreased deflection of the log saw blade 22 under more even lateral loading of the present invention can prolong log saw blade 22 life. Rotation of the log 24 with respect to the log saw blade 22 can also allow for placement of a plurality of thrust support rollers 34*c* on the same plane as the log saw blade path 40, thereby providing enhanced structural integrity of the log saw clamping assembly 18.

Once the "cookie" has been separated from the log 24, the pivoting clamp paddles 42 move concentrically outward away from the axis so the log pusher 14 can index the log 24 to the next desired position. The contact surfaces 70*a* can include a low friction surface to facilitate movement of the log 24 through the infeed and outfeed clamps 26 and 30. Further, as discussed above, the edges of the paddles 70 can be beveled or chamfered to provide further feeding guidance and to prevent gouging of the log 24. In the illustrated embodiment, the log 24 continues to rotate at approximately 300-400 RPM during the entire sawing and indexing process, although faster or slower speeds are possible. In other embodiments, the rotational speed of the log 24 is reduced or stopped to axially index the log 24 through the log saw clamping apparatus 18. After sawing, the sawn material can be discharged by the log pusher and then handled in a conventional manner. The log pusher can comprise any number of pushing or pulling mechanisms for placing a log 24 comprising rolled paper or other material to be sawn in the desired position.

In some embodiments, the counterweight 74 includes a counterweight pin 74*a* or other extension (FIG. 4) that contacts the pivot arm (e.g., the inner surface of the pivot arm 58 adjacent the first side plate 114 in the illustrated embodiment). If the pivoting clamp paddle 42 begins to pivot inward toward the axis 25 while the clamp 26, 30 is still in the open position, the counterweight pin 74*a* can be employed to restrict such movement. The counterweights 74 (acting through pin 74*a* and spring 78) bias the pivoting clamp paddles 42 to the open position when the clamps 26 and 30 are in a static or non-rotating mode of operation. This arrangement allows the pivoting clamp paddles 42 to move between the open and closed positions when the cam follower assembly 46 is rotated relative to the clamp housing assembly 50.

In other embodiments, the log 24 can be rotated independently of the infeed and outfeed clamps 26 and 30. By way of example only, a plurality of rollers can be utilized to substantially match the rotational speed of the log 24 to the rotational speed of the infeed and outfeed clamps 26 and 30. Such rollers can be driven by a variety of conventional mechanisms or can be driven by the drive mechanism 38.

In some embodiments, a plurality of log saw assemblies 10 are utilized in combination. The log saw assembly 10 can be adapted to interface with a second log saw assembly (e.g., employing two log saw assemblies 10 that are substantially the same). To this end, the barrel housing shaft 38*g* can include a splined connection 100 on the outfeed side of the frame 14 (FIG. 3). The splined connection 100 can be coupled with a barrel housing shaft of a second log saw assembly having a corresponding splined connection on the infeed side of the frame. When thus coupled, the motor 38*i* can drive the drive mechanism and the corresponding shafts, gears, and belts of the second log saw assembly. The differences between the log saw assembly 10 and a second connected log saw assembly can include minor alterations to the drive system of the second log saw assembly to ensure the log saw assembly 10 remains drivingly coupled to the second log saw assembly (e.g., by the addition of a clamp shaft that locks the splined connection 100 and a hand knob for disengaging the splined connection 100). One having ordinary skill in the art will appreciate that the barrel housing shaft 38*g* of the log saw assembly 10 can be drivably connected to a barrel housing shaft 38*g* of another log saw assembly 10 in a number of other conventional manners. In embodiments where multiple log saw assemblies are utilized, the axial indexing provided by the log pusher can be adjusted so that the first log saw provides preliminary cuts and the second log saw provides cuts that yield finished products.

In some alternative embodiments of the present invention, the clamp housing assembly 50 does not rotate, and the cam follower assembly 46 only rotates with respect to the clamp housing assembly 50 to open and close the clamps 26, 30 in a manner as described above. Depending at least partially upon the type of saw and blade employed, this arrangement can require the log saw blade 22 to pass through an entire section of the log 24. However, the unique clamping of the present invention still provides advantages over prior art clamps.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A rotating log saw clamp for clamping a product roll to be sawn, the rotating log saw clamp comprising:

clamping structure positionable about an axis for clamping a product roll;

a first portion adapted to receive the product roll therethrough, the first portion mounted concentrically with the axis and being selectively continuously rotatable in a first direction about the axis, the first portion adapted to move the clamping structure for selectively clamping and unclamping the product roll within the first portion; and a second portion adapted to receive the product roll therethrough, the second portion being mounted concentrically with the axis for selective continuous rotation about the axis in the first direction with the first portion and cooperatively drivingly connected to the first portion to be selectively movable about the axis relative to the first portion to move the clamping structure between open and clamping positions, the first portion and the second portion each being positively driven to cause the second portion to be rotatable relative to the first portion about the axis to move the clamping structure from the clamping position to the open position to unclamp the product roll and to move the clamping structure from the open position to the clamping position to clamp the product roll as a result of the cooperative drivable connection and relative rotation of the second portion with respect to the first portion during rotation of the first portion and the second portion in the first direction.

2. The rotating saw clamp of claim 1, wherein the second portion is rotatable with respect to the first portion to move the clamping structure between the open position in which the clamping structure is loosened with respect to the product roll in the clamp and the clamping position in which the clamping structure is tightened with respect to the product roll in the clamp.

3. The rotating saw clamp of claim 1, further comprising:

a first gear driving the first portion; and a second gear driving the second portion.

4. The rotating saw clamp of claim 3, further comprising:

a first rotatable shaft, the first gear being coupled to the first shaft; and a second rotatable shaft, the second gear being coupled to the second shaft for controlled rotation relative to the first shaft.

5. The rotating saw clamp of claim 4, further comprising:

a motor operable to rotate the second gear relative to the second shaft.

6. The rotating saw clamp of claim 4, further comprising:

a third gear coupled to the first shaft;

a fourth gear coupled to the second shaft; and a motor coupled to the third and fourth gears to drive the first and second shafts, respectively.

7. The rotating saw clamp of claim 1, the clamping structure comprising a plurality of clamp paddles, wherein the plurality of clamp paddles are pivotally coupled to the first portion and operatively coupled in a cam and cam follower arrangement to the second portion in such a manner that relative rotation in one direction between the first and second portions urges the plurality of clamp paddles to pivot toward the axis and into the clamping position in which the clamp is tightened with respect to the product roll in the clamp, and conversely such that relative rotation about the axis between the first and second portions in a second direction opposite the first direction urges the plurality of clamp paddles to pivot away from the axis and into the open position in which the clamp is loosened with respect to the product roll in the clamp.

8. The rotating saw clamp of claim 7, wherein the plurality of clamp paddles are biased toward the open position in which the clamp is loosened with respect to the product roll in the clamp.

9. The rotating saw clamp of claim 8, further comprising a corresponding plurality of counterweights, each one of the plurality of counterweights coupled to a respective one of the plurality of clamp paddles.

10. The rotating saw clamp of claim 9, further comprising a corresponding plurality of springs, each one of the plurality of springs coupled between a respective one of the plurality of counterweights and the first portion, the plurality of springs biasing the plurality of clamp paddles toward the open position.

11. The rotating saw clamp of claim 7, wherein each of the plurality of clamp paddles includes a cam surface, the second portion including a corresponding plurality of cam followers rotatably coupled to the second portion, each one of the plurality of cam surfaces being movable with respect to a respective one of the plurality of cam followers to pivot a respective one of the plurality of clamp paddles.

12. The rotating saw clamp of claim 11, wherein each one of the plurality of cam followers moves along a respective one of the plurality of cam surfaces to move a respective one of the plurality of clamp paddles toward the clamping position when the second portion rotates relative to the first portion in the one direction.

13. The rotating saw clamp of claim 12, wherein each one of the plurality of cam followers moves along a respective one of the plurality of cam surfaces to allow a respective one of the plurality of clamp paddles to move toward the open position when the second portion rotates relative to the first portion in the opposite direction.

14. The rotating saw clamp of claim 1, wherein the first portion is at least partially defined by a ring, and wherein the second portion is at least partially defined by a ring.

15. A rotating log saw clamp for clamping a product roll to be sawn, the rotating log saw clamp comprising:

clamping structure positionable about a clamp axis for clamping a product roll;

a first ring for receiving the product roll therethrough, the first ring mounted concentrically with the clamp axis and adapted to move the clamping structure for selectively clamping and unclamping the product roll, the first ring being driven for rotation about the clamp axis by a first drive in such a manner that the first ring is selectively rotatable continuously about an axis of the product roll to be sawn; and a second ring for receiving the product roll therethrough, the second ring mounted concentrically with the clamp axis and rotatably coupled to the first ring, the second ring driveable for rotation about the clamp axis by the first drive and further driveable for rotation relative to the first ring by a second drive, the second ring adapted to be selectively continuously rotatable with the first ring, whereby the second ring is rotatable about the axis of the product roll and is rotatable relative to the first ring as the first and second rings rotate together in a common direction, the second ring being rotated relative to the first ring to selectively move the clamping structure toward and away from the clamp axis to adjust the clamping of the product roll.

16. The rotating saw clamp of claim 15, wherein the second ring is rotatable relative to the first ring in two directions.

17. The rotating saw clamp of claim 15, further comprising:

a first gear driving the first ring; and a second gear driving the second ring.

18. The rotating saw clamp of claim 17, further comprising:

a first rotatable shaft, the first gear being coupled to the first shaft; and a second rotatable shaft, the second gear being coupled to the second shaft for controlled rotation relative to the second shaft.

19. The rotating saw clamp of claim 18, further comprising:

a motor operable to rotate the second gear relative to the second shaft.

20. The rotating saw clamp of claim 18, further comprising:

a third gear coupled to the first shaft;

a fourth gear coupled to the second shaft; and a motor coupled to the third and fourth gears to drive the first and second shafts, respectively.

21. The rotating saw clamp of claim 15, the clamping structure comprising a plurality of clamp members, wherein the plurality of clamp members are pivotally coupled to the first ring, and wherein the plurality of clamp members are pivotable toward the clamp axis and away from the clamp axis.

22. The rotating saw clamp of claim 21, wherein the plurality of clamp members are biased away from the clamp axis.

23. The rotating saw clamp of claim 22, further comprising a plurality of counterweights, each one of the plurality of counterweights coupled to a respective one of the plurality of clamp members.

24. The rotating saw clamp of claim 23, further comprising a plurality of springs, each one of the plurality of springs coupled between a respective one of the plurality of counterweights and the first ring, the plurality of springs biasing the plurality of clamp members away from the clamp axis.

25. The rotating saw clamp of claim 22, wherein each one of the plurality of clamp members includes a cam surface, the second ring including a plurality of cam followers rotatably coupled to the first ring, the plurality of cam followers being movable with respect to the plurality of cam surfaces to move the plurality of clamp members.

26. The rotating saw clamp of claim 25, wherein the plurality of cam followers move along the plurality of cam surfaces to move the plurality of clamp members toward the clamp axis when the second ring rotates relative to the first ring in one direction.

27. The rotating saw clamp of claim 26, wherein the plurality of cam followers move along the plurality of cam surfaces to allow the plurality of clamp members to move away from the clamp axis when the second ring rotates relative to the first ring in another direction.

28. A rotating log saw clamp for clamping a product roll to be sawn, the rotating log saw clamp comprising:

a frame;

a housing adapted to receive a product roll therethrough, the housing mounted concentrically with an axis and rotatably coupled to the frame for selective continuous rotation about the axis, the housing disposed for rotation with the product roll to be sawn;

a plurality of clamp members positioned about the axis and movable relative to the axis for clamping the product roll; and a ring adapted to receive the product roll therethrough, the ring mounted concentrically with the axis and rotatably coupled to the housing for selective continuous rotation about the axis with the housing, the housing and the ring each being positively driven to cause the ring to be rotatable about the axis in two opposite directions relative to the housing while the ring and the housing rotate in a single direction, wherein the relative movement about the axis of the ring and the housing with respect to one another selectively moves the plurality of clamp members toward and away from the axis.

29. The rotating saw clamp of claim 28, further comprising:

a first gear driving the housing; and a second gear driving the ring.

30. The rotating saw clamp of claim 29, further comprising:

a first rotatable shaft, the first gear being coupled to the first shaft; and a second rotatable shaft, the second gear being coupled to the second shaft for controlled rotation relative to the second shaft.

31. The rotating saw clamp of claim 30, further comprising:

a motor operable to rotate the second gear relative to the second shaft.

32. The rotating saw clamp of claim 30, further comprising:

a third gear coupled to the first shaft;

a fourth gear coupled to the second shaft; and a motor coupled to the third and fourth gears to drive the first and second shafts, respectively.

33. The rotating saw clamp of claim 28, wherein the plurality of clamp members are pivotally coupled to the housing.

34. The rotating saw clamp of claim 33, wherein the plurality of clamp members are biased away from the axis.

35. The rotating saw clamp of claim 34, further comprising a corresponding plurality of counterweights, each one of the plurality of counterweights coupled to a respective one of the plurality of clamp members.

36. The rotating saw clamp of claim 35, further comprising a plurality of springs, each one of the plurality of springs coupled between a respective one of the plurality of counterweights and the housing, the plurality of springs biasing the plurality of clamp members.

37. The rotating saw clamp of claim 33, wherein each one of the plurality of clamp members includes a cam surface, the ring including a corresponding plurality of cam followers rotatably coupled to the ring, each one of the plurality of cam followers being moveable with respect to a respective one of the plurality of cam surfaces to move a respective one of the plurality of clamp members.

38. The rotating saw clamp of claim 37, wherein each one of the plurality of cam followers moves along a respective one of the plurality of cam surfaces to move a respective one of the plurality of clamp members toward the axis when the ring rotates relative to the housing in one direction.

39. The rotating saw clamp of claim 38, wherein each one of the plurality of cam followers moves along a respective one of the plurality of cam surfaces to allow a respective one of the plurality of clamp members to move away from the axis when the ring rotates relative to the housing in the other direction.

* * * * *

UNITED STATES PATENT AND TRADEMARK OFFICE

CERTIFICATE OF CORRECTION

PATENT NO. : 7,810,419 B2
APPLICATION NO. : 10/359029
DATED : October 12, 2010
INVENTOR(S) : Wayne G. Rundell et al.

It is certified that error appears in the above-identified patent and that said Letters Patent is hereby corrected as shown below:

In the Claims:

In column 18, claim 36, line 40, replace the "." immediately following "members" with a -- , -- and add after the "," "away from the axis."

Signed and Sealed this
Seventh Day of August, 2012

David J. Kappos

David J. Kappos
*Director of the United States Patent and Trademark Office*